US008201504B2

(12) United States Patent
O'Donnell et al.

(10) Patent No.: US 8,201,504 B2
(45) Date of Patent: Jun. 19, 2012

(54) RAILCAR CONSTANT CONTACT SIDE BEARING ASSEMBLY

(75) Inventors: William P. O'Donnell, Aurora, IL (US); Erik D. Jensen, Batavia, IL (US); Paul B. Aspengren, North Aurora, IL (US); Michael D. VanMaldegiam, North Aurora, IL (US); Paul A. Perlongo, St. Charles, IL (US); Mark W. Stanek, Aurora, IL (US); Adam J. Merges, Batavia, IL (US)

(73) Assignee: Miner Enterprises, Inc., Geneva, IL (US)

( * ) Notice: Subject to any disclaimer, the term of this patent is extended or adjusted under 35 U.S.C. 154(b) by 314 days.

(21) Appl. No.: 12/460,416

(22) Filed: Jul. 17, 2009

(65) Prior Publication Data

US 2011/0011301 A1 Jan. 20, 2011

(51) Int. Cl.
*B61F 3/00* (2006.01)

(52) U.S. Cl. ..... 105/199.3

(58) Field of Classification Search ..... 105/182.1, 105/199.1, 199.3, 200, 211, 212, 213; 267/6, 267/292, 150, 153; 384/420, 423
See application file for complete search history.

(56) References Cited

U.S. PATENT DOCUMENTS

| | | | |
|---|---|---|---|
| 946,261 | A | 1/1910 | O'Connor |
| 1,179,755 | A | 4/1916 | Price et al. |
| 1,193,313 | A | 8/1916 | Townsend |
| 1,233,348 | A | 7/1917 | Hansson |
| 1,252,358 | A | 1/1918 | Miner |
| 1,290,319 | A | 1/1919 | O'Connor |
| 1,722,668 | A | 7/1929 | Lane |
| 1,808,839 | A | 6/1931 | Davis |
| 2,197,783 | A | 4/1940 | Barrows |
| 2,259,608 | A | 10/1941 | Blattenr |
| 2,285,140 | A | 6/1942 | Barrows et al. |
| 2,541,769 | A | 2/1951 | Keysor |
| 2,571,190 | A | 10/1951 | Blattner |
| 2,636,789 | A | 4/1953 | Blattner |
| 2,830,857 | A | 4/1958 | Balttenr |
| 3,151,918 | A | 10/1964 | Bachman et al. |
| 3,401,991 | A | 9/1968 | McDonnell |
| 3,514,169 | A | 5/1970 | McDonnell |

(Continued)

OTHER PUBLICATIONS

International Searching Authority; International Search Report regarding PCT/US2010/01750; Aug. 19, 2010; 3 pages.

(Continued)

*Primary Examiner* — S. Joseph Morano
*Assistant Examiner* — R. J. McCarry, Jr.
(74) *Attorney, Agent, or Firm* — Law Office of John W. Harbst

(57) ABSTRACT

A constant contact side bearing assembly for a railcar including a housing with wall structure defining a central axis for the side bearing assembly and a multipiece cap. The cap is arranged in operable combination with the housing and includes a movable first member and a movable second member carried by the first member. A portion of the second member extends beyond the housing and defines a friction surface for the cap. A spring resiliently urges the friction surface of the cap into frictional contact with railcar body structure. The cap members define cooperating angled surfaces therebetween for urging wall structure on the first member and wall structure on the second member into frictional engagement with the wall structure on said housing in response to a vertical load acting on the friction contacting surface on the cap.

26 Claims, 4 Drawing Sheets

U.S. PATENT DOCUMENTS

| | | | | |
|---|---|---|---|---|
| 3,600,047 | A | 8/1971 | McDonnell | |
| 4,924,779 | A | 5/1990 | Curtis et al. | |
| 5,086,707 | A | 2/1992 | Spencer et al. | |
| RE34,129 | E | 11/1992 | Wright | |
| 5,315,934 | A | 5/1994 | List | |
| 5,601,031 | A * | 2/1997 | Carlson | 105/199.3 |
| 5,806,435 | A * | 9/1998 | Pitchford | 105/199.3 |
| 6,092,470 | A | 7/2000 | O'Donnell et al. | |
| 6,644,214 | B1 | 11/2003 | Schoor | |
| 6,792,871 | B2 | 9/2004 | O'Donnell et al. | |
| 7,338,034 | B2 | 3/2008 | Aspengren et al. | |
| 2006/0117985 | A1 | 6/2006 | Forbes et al. | |
| 2009/0308276 | A1 | 12/2009 | Aitken et al. | |

OTHER PUBLICATIONS

International Searching Authority; Writtenm Opinion of the International Searching Authority regarding PCT/US2010/01750; Aug. 19, 2010; 8 pages.

* cited by examiner

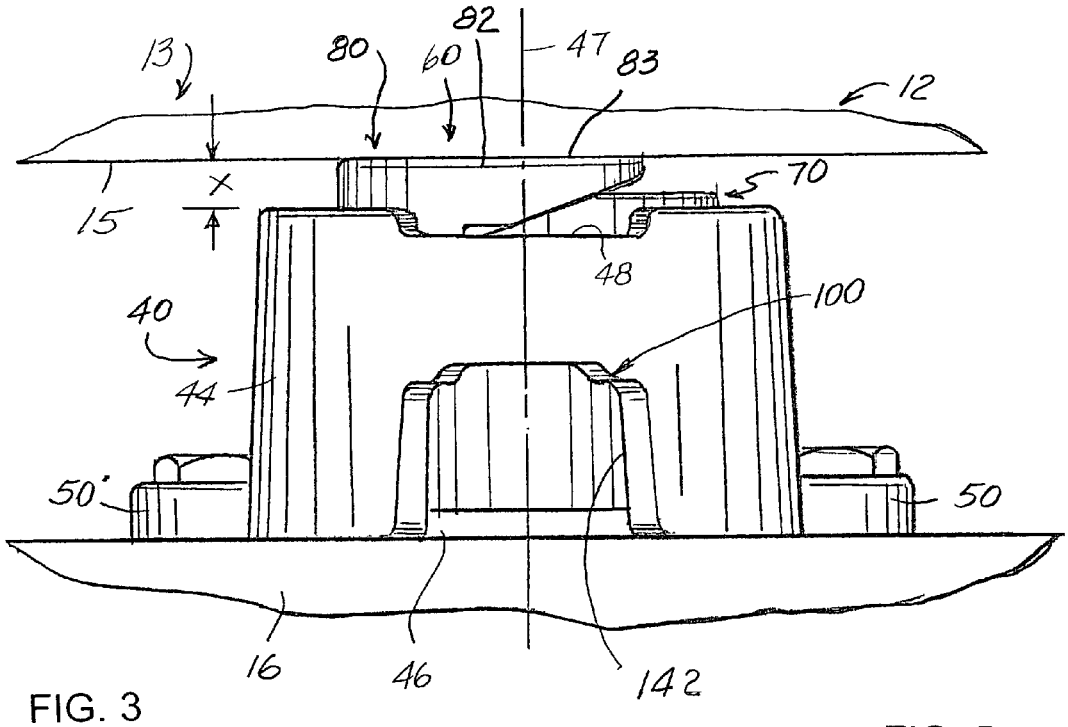
FIG. 3
FIG. 5
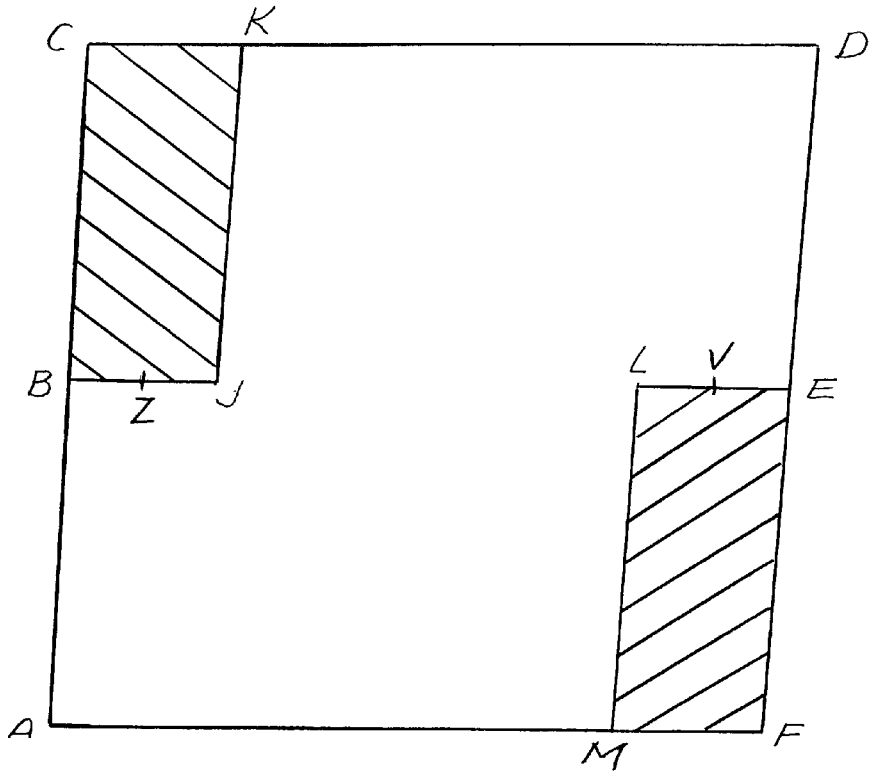

RAILCAR CONSTANT CONTACT SIDE BEARING ASSEMBLY

FIELD OF THE INVENTION DISCLOSURE

The present invention disclosure generally relates to railroad cars and, more specifically, to a constant contact side bearing assembly for a railroad car.

BACKGROUND

A typical railroad freight car includes a car body supported on a pair of wheeled trucks which are confined to roll on rails or tracks. Each truck includes a bolster extending essentially transversely of the car body longitudinal centerline. In the preponderance of freight cars, a pivotal connection is established between the bolster and railcar body by center bearing plates and bowls transversely centered on the car body underframe and the truck bolster. Accordingly, the truck is permitted to pivot on the center bearing plates under the car body. As the railcar moves between locations, the car body also tends to adversely roll from side to side.

Attempts have been made to control the adverse roll of the railcar body through use of side bearings positioned on the truck bolster outwardly of the center bearing plates. A "gap style" side bearing has been known to be used on slower moving tank/hopper railcars. Conventional "gap style" side bearings include a metal, i.e. steel, block or pad accommodated within an elongated open top pocket or recess defined on the truck bolster. An elongated and upstanding housing or cage, integrally formed with or secured, as by welding or the like, to an upper surface on the truck bolster defines the open top recess and inhibits sliding movement of the metal block relative to the bolster. As is known, a gap or vertical space is usually present between the upper surface of the "gap style" side bearing and the underside of the railcar body.

Other conventional "gap style" side bearings have included roller bearings carried for rolling movements within the elongated housing or carrier mounted on the upper surface of the railcar bolster. The roller extends above an uppermost extent of the housing or carrier and engages with an underside of the railcar body. Such side bearings are able to support the railcar body with respect to the bolster while at the same time permitting the bolster, and therefore the truck, freedom to rotate with respect to the car body as is necessary to accommodate normal truck movements along both straight and curved track.

Under certain dynamic conditions, coupled with lateral track irregularities, the railcar truck also tends to adversely oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and truck. Excessive "hunting" can result in premature wear of the wheeled truck components including the wheels, bolsters, and related equipment. Hunting can also furthermore cause damage to the lading being transported in the car body.

Track speeds of rail stock, including tank/hopper cars, continue to increase. Increased rail speeds translate into corresponding increases in the amount of hunting movements of the wheeled trucks. "Gap style" or those side bearings including roller bearings simply cannot and do not limit hunting movements of the wheeled trucks. As such, the truck components including the wheels, bolsters, and related equipment tend to experience premature wear.

The art has also contemplated constant contact side bearings for railcars. Constant contact railcar side bearings not only support a railcar body with respect to the bolster during relative rotational movements therebetween but additionally serve to dissipate energy through frictional engagement between the underside of the railcar body and a bearing element thereby limiting destructive truck hunting movements. Constant contact side bearings typically include a housing assembly including a base and a cap. The base usually has a cup-like configuration and includes at least two apertured flanges, extending in opposed radial directions relative to each other, permitting the base to be suitably fastened to the bolster. In one form, the cap is biased from the base and includes an upper surface for contacting and rubbing against a car body underside. The cap must be free to vertically move relative to the side bearing base.

Such constant contact side bearings furthermore include a spring. The purpose of such spring is to absorb, dissipate, and return energy imparted thereto during a work cycle of the side bearing assembly and resiliently position the upper surface of the cap, under a preload force, into frictional contact with the car body underframe. The spring for such side bearings can comprise either spring loaded steel elements or elastomeric blocks or a combination of both operably positioned between the side bearing base and the cap. An elastomeric block which has been found particularly beneficial is marketed and sold by the Assignee of the present invention under the tradename "TecsPak." As will be appreciated, however, such an elastomeric block, by itself, lacks longitudinal stiffness and, thus, requires surrounding housing structure to provide added support and stiffness thereto.

There are at least two design challenges presented in connection with the design of a constant contact side bearing assembly. First, and during the course of operation, the sliding clearance between the base and cap of a constant contact side bearing assembly becomes enlarged due to abrasion and wear. Such wear is a critical performance detractor to the side bearing assembly. That is, any gap between the base and cap of the side bearing housing assembly adversely permits longitudinal or horizontal shifting movements of the cap relative to the housing thereby reducing the energy absorption capability for the side bearing assembly—a critical operating criteria for the side bearing assembly. Of course, if the gap between the base and cap of the side bearing housing assembly reaches a critical limit, the side bearing assembly is no longer useful and will be condemned.

A second design challenge involves those constant contact side bearings which use an elastomeric spring and relates to the buildup of heat in proximity to the elastomeric spring. During operation of the railcar, frictional contact between the railcar body and the side bearing assembly results in the development of heat buildup. Unless such heat buildup can be controlled, the elastomeric spring will tend to soften and deform, thus, adversely affecting the operable performance of the constant contact side bearing assembly.

The frictional sliding relationship between the side bearing assembly and the related railcar component can create a temperature within the side bearing assembly that can exceed the heat deflection temperature of the elastomeric spring thus causing the elastomeric spring to deform. As used herein and throughout, the term "heat deflection temperature" means and refers to a temperature level at the which the elastomeric spring, regardless of its composition, tends to soften and deform. Deformation of the elastomeric spring can significantly reduce the ability of the elastomeric spring to apply a proper preload force and, thus, decreases vertical suspension characteristics of the side bearing assembly which, in turn, results in enhanced hunting of the wheeled truck. Enhanced hunting and/or unstable cyclic yawing of the truck increases the resultant translation/oscillation of the railcar leading to a further increase in the heat buildup and further deterioration of the elastomeric spring.

Thus, there is a continuing need and desire for a railcar constant contact side bearing assembly having components which are designed to optimize energy absorption and related performance criteria for the side bearing assembly while inhibiting deterioration of an elastomeric spring resulting from localized heat.

SUMMARY

According to one aspect, there is provided a constant contact side bearing assembly for a railcar including a housing and a multipiece cap arranged in operable combination with each other. The side bearing assembly housing includes upstanding wall structure defining a central axis for the side bearing assembly. The multipiece cap includes a first member arranged within the housing and has depending wall structure arranged to frictionally contact the wall structure of the housing arranged to one side of the central axis during operation of the side bearing assembly. The wall structure of the first member is arranged to one side of the central axis of the side bearing assembly. The second member of the multipiece cap is arranged at least partially within the housing and is carried by the first member. Like the first member, the second member includes depending wall structure arranged to frictionally contact the wall structure of the side bearing housing arranged to an opposite or second side of the central axis of the side bearing assembly during operation of the side bearing assembly. A friction surface on the second member extends beyond the wall structure of the housing for engagement by a related part on the railcar. A spring is arranged within the housing for urging the friction surface on the cap into frictional contact with the related part on the railcar. The members of the multipiece cap define non-vertical interengaging and slidable surfaces therebetween for maintaining the depending wall structure on each member in frictional contact with the wall structure of the housing thereby limiting horizontal shifting movements of the friction surface relative to the housing thus effecting greater energy absorption during operation of the side bearing assembly.

In one form, the non-vertical interengaging and slidable surfaces defined between the members of the multipiece cap are disposed at an angle ranging between about 20° and about 30° relative to a horizontal plane. Preferably, the housing and multipiece cap define cooperating instrumentalities for guiding the first and second members for vertical reciprocatory movements relative to the housing and for maintaining a predetermined relation between the first and second members and the housing.

In one embodiment, the spring for the constant contact side bearing assembly includes an elastomeric member. To prolong the usefulness of the elastomeric spring, the side bearing assembly is vented to promote the dissipation of heat therefrom. Preferably, the multipiece cap is configured to allow air to pass beneath the friction surface of the cap.

In one form, the constant contact side bearing assembly housing includes a base with generally horizontal flange portions extending in opposite directions and away from the central axis of the side bearing assembly. To facilitate securement of the side bearing assembly to a railcar bolster, each flange portion defines an aperture therein. In one embodiment, the apertures defined by the flange portions on the housing are aligned relative to each other and extend generally parallel to a longitudinal axis of the railcar. Preferably, the base of the side bearing assembly housing supports one end of the spring.

According to another aspect, there is provided a constant contact side bearing assembly for a railcar including a housing and a multipiece cap arranged in operable combination with each other. The housing includes wall structure and a central axis for the side bearing assembly. The multipiece cap includes a first member arranged for vertical movement within the housing and a second member vertically movable within the housing and carried by the first member. A portion of the second member is arranged to frictionally contact a railcar body structure. A spring is arranged within the housing for. resiliently urging a portion of the cap into frictional contact with the railcar body structure. The multipiece cap members define cooperating angled surfaces therebetween for urging the first and second members into frictional engagement with the wall structure on the housing in response to a vertical load acting on the cap.

Preferably, the angled surfaces defined between the members of the multipiece cap are disposed at an angle ranging between about 20° and about 30° relative to a horizontal plane. In one form, the side bearing assembly spring includes an elastomeric member. So as to prolong the useful life of the elastomer spring, the side bearing assembly housing is vented for allowing heat to be dissipated from the housing. Moreover, the multipiece cap is configured to allow air to pass beneath the portion of the cap arranged to frictionally contact the railcar body structure.

In one form, the side bearing assembly housing includes a base with generally horizontal mounting flanges extending in opposite directions and away from the central axis of the side bearing assembly. Each mounting flange defines an aperture therein. The apertures defined by the flange portions are preferably aligned relative to each other along a longitudinal axis extending generally parallel to an elongated longitudinal axis of the railcar. In one form, the the base of the side bearing assembly housing supports one end of the spring.

The side bearing assembly housing and at least one member of the multipiece cap define cooperating instrumentalities for guiding the cap members for vertical reciprocatory movements relative to the housing and for maintaining a predetermined relation between the cap members and the housing. In one form, the cooperating instrumentalities are arranged in line with the longitudinal axis defined by the aligned apertures in the mounting flanges of the side bearing assembly housing.

According to another aspect, there is provided a constant contact side bearing assembly for a railcar including a housing and a multipiece cap arranged in operable combination relative to each other. The side bearing assembly housing has vertical wall structure and defines a central axis for the side bearing assembly. The multipiece cap includes a spring seat arranged within the housing for vertical movement and a top cap. The top cap is arranged within the housing for vertical movement and has a plate portion spaced above the wall structure of the housing. The top cap is carried by the spring seat. A spring is arranged within the housing for resiliently urging the plate portion of the multipiece cap into frictional contact with a part on the railcar. The spring seat and top cap define cooperating angled surfaces therebetween for urging the spring seat and top cap in opposed directions away from the central axis of the side bearing assembly such that wall structure, on each of the spring seat and top cap, is moved onto friction engagement with the wall structure on the housing in response to a vertical load acting on the plate portion of the multipiece cap.

Preferably, the cooperating angled surfaces between the spring seat and top cap are disposed at an angle ranging between about 20° and about 30° relative to a horizontal plane. In one embodiment, the spring for the side bearing assembly includes an elastomeric member. To prolong the useful life of the elastomeric spring, the side bearing assembly housing defines a pair of openings for venting heat from the housing. Moreover, the top cap defines an opening for allowing air to pass beneath the plate portion of the top cap.

In one form, the side bearing assembly housing includes a base with generally horizontal mounting flanges extending in opposite directions and away from the central axis of the side bearing assembly. To facilitate securement of the side bearing assembly to a railcar bolster, each mounting flange preferably defines an aperture therein. Additionally, the base of the side bearing assembly housing supports one end of the spring.

In one embodiment, the apertures defined by the mounting flanges are aligned relative to each other along a longitudinal axis extending generally parallel to an elongated longitudinal axis of the railcar. Preferably, the side bearing assembly housing and at least one member of the multipiece cap define cooperating instrumentalities for guiding the spring seat and top cap for vertical reciprocatory movements relative to the housing and for maintaining a predetermined relation between the spring seat, top cap and the housing. In one form, the cooperating instrumentalities defined by the side bearing assembly housing and at least one member of the multipiece cap are arranged in line with the axis defined by the aligned apertures in the mounting flanges of the side bearing assembly housing.

DESCRIPTION OF THE DRAWINGS

FIG. 3 is a right side elevational view of the constant contact side bearing assembly illustrated in FIG,. 2;

FIG. 5 is representative of a force-displacement plot of hysteresis loops of both a prior art type constant contact side bearing assembly and an embodiment of a constant contact side bearing assembly according to this invention disclosure.

DETAILED DESCRIPTION

Figure 1:
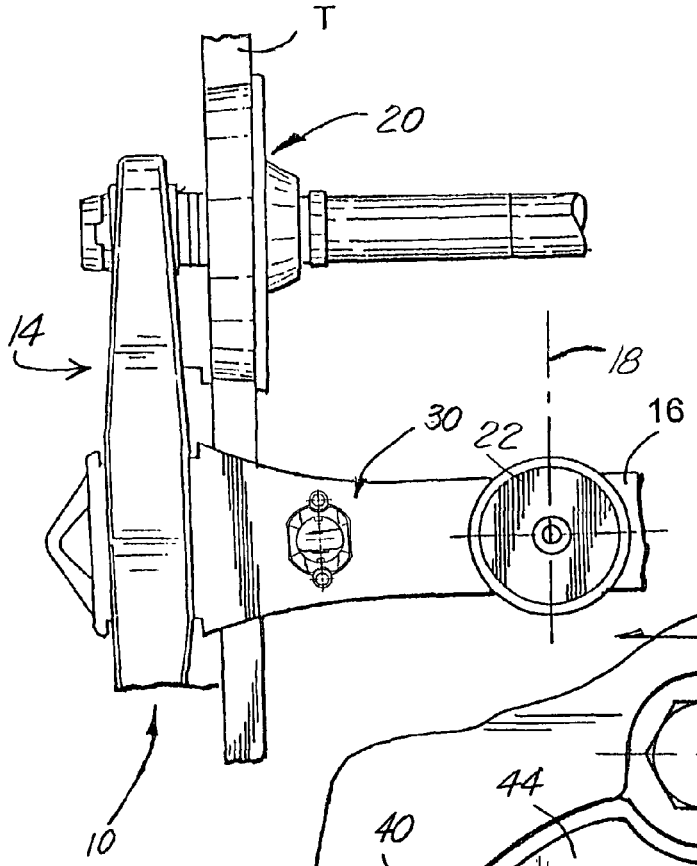
FIG. 1 is a top plan view of a portion of a railroad car wheeled truck including one form of a constant contact side bearing assembly embodying principals of this invention disclosure.

While this invention disclosure is susceptible of embodiment in multiple forms, there is shown in the drawings and will hereinafter be described a preferred embodiment, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, FIG. 1 shows a fragment of a railcar wheeled truck assembly, generally indicated by reference numeral 10, for supporting and allowing a railcar body 12 defining a part of a railcar 13 (FIG. 3) to ride along and over tracks T. Truck assembly 10 is of a conventional design and includes a side frame 14, a bolster 16, extending generally transversely relative to a longitudinal centerline 18 of the railcar body 12 (FIG. 3), and a wheel set 20. A conventional center bearing plate 22 is suitably mounted on the bolster 16 for pivotally supporting one end of the car body 12 (FIG. 3).

A railroad car side bearing assembly embodying principals of this invention disclosure is generally indicated in FIG. 1 by reference numeral 30 and is arranged in operable combination with each wheeled truck assembly 10. More specifically, and as is conventional, a railroad car side bearing assembly is mounted on an upper surface of the railcar bolster 16 on opposite lateral sides of the center bearing plate 22 to limit hunting movements and oscillation of the wheeled truck assembly 10 as the railcar moves over the tracks T.

Figure 2:
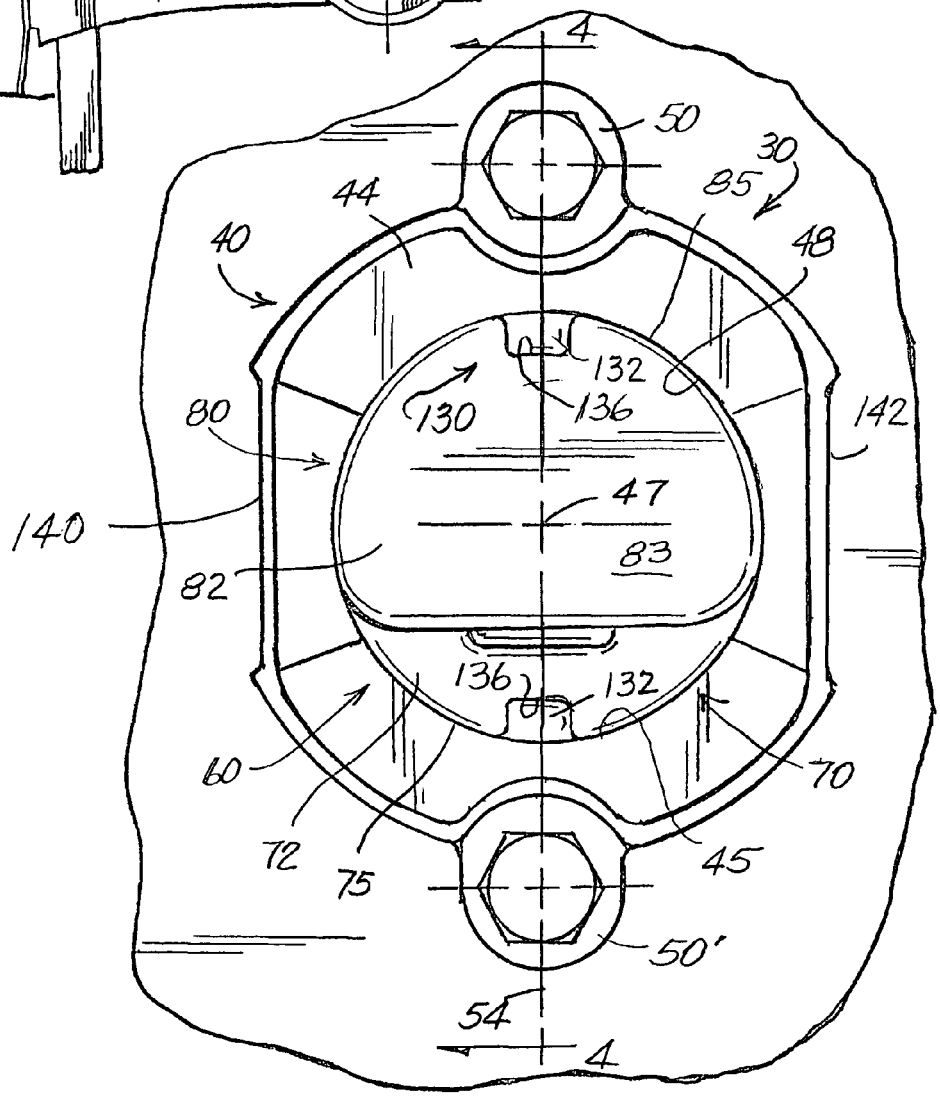
FIG. 2 is an enlarged top plan view of the constant contact side bearing assembly illustrated in FIG. 1.

The configuration of the side bearing assembly 30 is not an important consideration of the present disclosure. The side bearing assembly 30 illustrated in the drawings is for exemplary purposes. Whereas, the principals and teachings set forth below are equally applicable to other side bearings having different forms and shapes. Turning to FIG. 2, side bearing assembly 30 includes a housing or cage 40, a multipiece cap 60 arranged for generally telescoping or vertical reciprocatory movements relative to the housing 40, and a spring 100 (FIG. 4).

Figure 4:
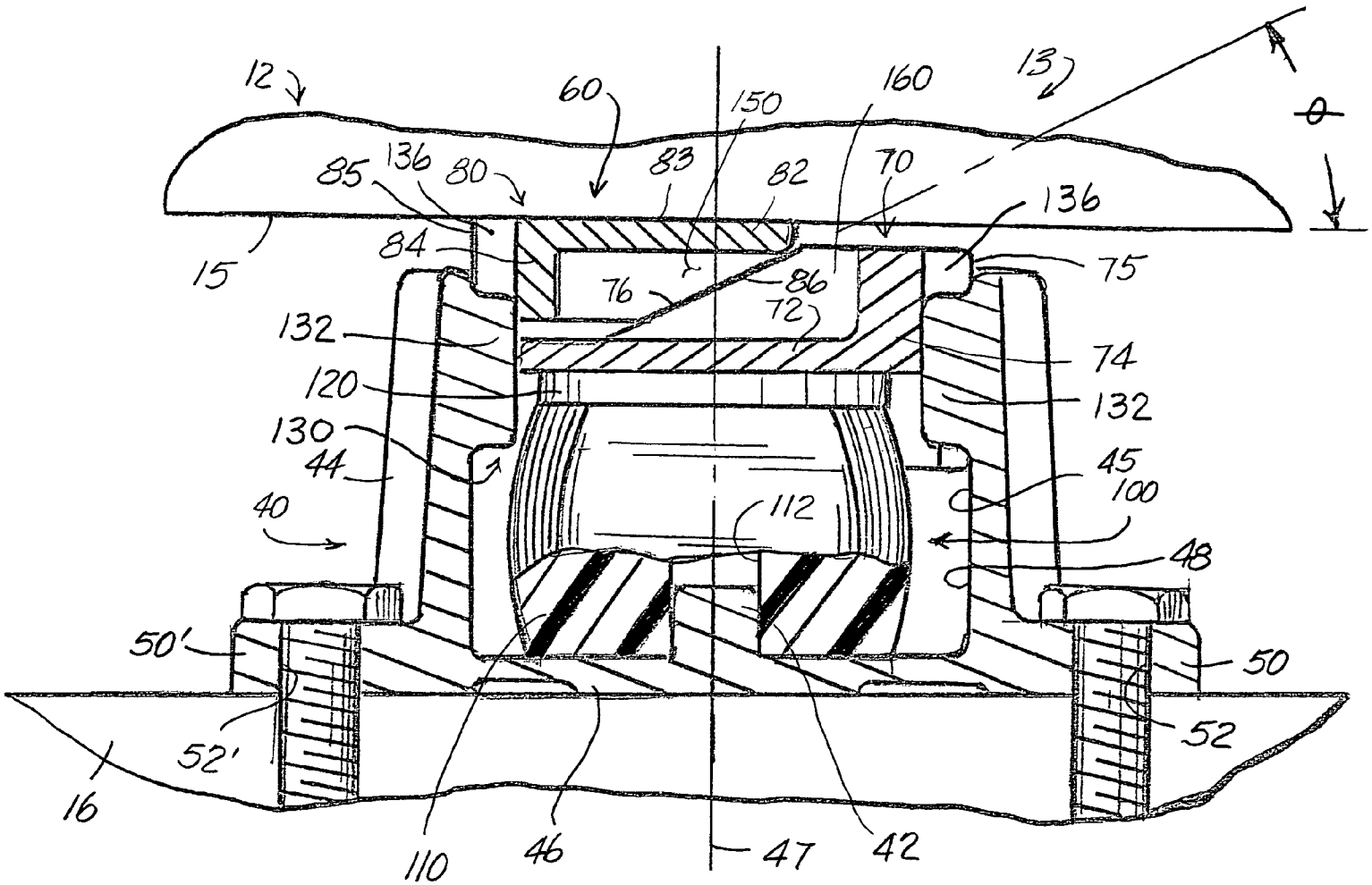
FIG. 4 is an enlarged sectional view taken along line 4-4 of FIG. 2.

Housing 40 is preferably formed of a strong and wear resistant metal material such as steel or the like and, in the form shown in FIGS. 2, 3 and 4, includes wall structure 44 extending upwardly from a base 46 to define an axis 47 for side bearing assembly 30. The housing wall structure 44 extends upwardly from the base 46 for a predetermined distance and has a predetermined inner surface configuration 45. The wall structure 44 of the side bearing housing 40 defines an open-top cavity or internal void 48.

The housing base 46 is configured for suitable attachment to an upper surface 17 of the railcar bolster 16 as through any suitable means, i.e. threaded bolts or the like. In the illustrated embodiment, housing base 46 includes a pair of mounting flanges 50 and 50' radially extending outwardly in opposed directions away from the side bearing assembly axis 47. Each mounting flange 50, 50' defines a bore or aperture 52, 52' (FIG. 4), respectively, for allowing a suitable fastener to extend therethrough whereby permitting the housing 40 to be fastened to the upper surface 17 of the bolster 16. Preferably, the bores or apertures 52, 52' are aligned relative to each other along a longitudinal axis 54 such that, when housing 40 is secured to the bolster 16, axis 54 extends generally parallel to the longitudinal axis 18 of car body 12.

The multipiece cap 60 for the side bearing assembly 30 includes a first member or spring seat 70 and a second member or top cap 80 arranged in operable combination relative to each other. Both members 70 and 80 are preferably made from a strong and wear resistant metal material such as steel or the like. As shown in FIG. 4, the spring seat 70 is positioned within the housing 40 for generally vertical movements and includes an upper generally horizontal bed or supporting plate 72 and upstanding wall structure 74. When arranged within the side bearing housing 40, the wall structure 74 of member 70 is arranged to one side of the vertical axis 47 of the side bearing assembly 30. Preferably, wall structure 74 is formed integral with the supporting plate 72. Notably, and as shown in FIGS. 2 and 4, an outer surface 75 on the upstanding wall structure 74 complements the inner surface 45 of the side bearing housing wall structure 44 arranged to one side of the vertical axis 47 of the side bearing assembly 30. In the embodiment illustrated for exemplary purposes, side bearing housing inner surface 45 and the spring seat outer wall surface 75 each have a curved surface configuration which complement each other and promote sliding movement therebetween.

As shown in FIG. 2, the second member 80 is at least partially positioned within the housing 40 for generally vertical movements and is operably carried by the first member 70. Member 80 desirably includes a generally horizontal plate 82 defining an upper generally planar surface 83 which is adapted to frictionally engage and slide relative to an underside 15 of the car body 12 (FIG. 2). When the side bearing assembly 30 is secured to the bolster 16, at least a portion of the planar surface 83 of member 80 is disposed above a terminal end of the upstanding wall structure 44 of the side bearing housing for a predetermined distance. In the example shown, the normal distance between surface 83 of member 80 and the top edge of the wall structure 44, indicated by the distance "X" in FIG. 3, is determinative of the permissible compressive movement of the side bearing assembly 30 and such that after the underside 15 of the railcar body 12 contacts the upper edge of the housing structure 44, the side bearing assembly 30 functions as a solid unit and will prevent further rocking and relative movement between the bolster 16 and the railcar body 12.

As shown, member 80 furthermore includes upstanding wall structure 84 which, when member 80 is assembled in operable relation with the side bearing assembly is disposed to an opposite side of the axis 47 from upstanding wall structure 74 of member 70. Preferably, wall structure 84 is formed integral with plate 82. As shown in FIGS. 2 and 4, an outer surface 85 on wall structure 84 complements the side bearing housing wall structure inner surface 45 disposed to an opposed side of the vertical axis 47 of the side bearing assembly 30 from surface 75 of member 70. In the embodiment illustrated for exemplary purposes, the side bearing housing inner surface 45 and the wall structure outer surface 85 on member 80 each have a curved surface configuration which complement each other and promote sliding movement therebetween.

One of the salient aspects of this invention disclosure relates to the ability to limit—if not eliminate—horizontal shifting movements of the side bearing assembly cap 60 relative to the side bearing assembly housing 40 whereby significantly enhancing operating performance characteristics of the side bearing assembly 30. To accomplish this desired end, and as illustrated in FIG. 4, the first and second members 70 and 80 of the multipiece cap 60 define non-vertical interengaging and slidable surfaces 76 and 86, respectively, therebetween for maintaining the outer surfaces 75 and 85 of members 70 and 80 in frictional sliding contact with the inner surface 45 of the side bearing housing 40. That is, and in response to vertical load being placed on the planar surface 83 of the side bearing assembly 30, the cooperating angled surfaces 76 and 86 defined by the respective first and second members 70 and 80 of the multipiece cap 60 urge the spring seat 70 and member 60 in opposite directions relative to each other and away from the centerline or upstanding axis 47 of the side bearing assembly 30 such that the outer surfaces 75 and 85 on each of the first and second member 70 and 80, respectively, are constantly urged toward frictional sliding engagement with the inner surface 45 of the side bearing housing 40.

In one form, the non-vertical surfaces 76 and 86 of the first and second members 70 and 80 of the multipiece side bearing assembly cap 60 are disposed at a predetermined angle θ. In one form, the predetermined angle θ ranges between about 20° and about 30° relative to a horizontal plane. In a most preferred form, the cooperating angled surfaces 78 and 78 between the first and second members 70 and 80, respectively, of cap 60 are disposed at an angle of about 25° relative to a horizontal plane.

Since the side bearing assembly 30 of the present disclosure is of a resilient type, it is essential some form of yieldable apparatus be incorporated therein. In this regard, spring 100 is arranged in operable combination with and for absorbing, dissipating and returning energy imparted to the multipiece cap 60. As shown, spring 100 is arranged and accommodated within the cavity 48 defined by housing 40.

Like the overall side bearing, the exact shape of form of the spring 100 can vary or be different from that illustrated for exemplary purposes without detracting or departing from either the spirit or scope of this invention disclosure. In the embodiment illustrated in FIG. 4, spring 100 is comprised of a formed and resiliently deformable thermoplastic elastomer member 110 and a thermal insulator 120.

In the embodiment illustrated for exemplary purposes in FIG. 4, member 110 of spring 100 has a configuration suitable for accommodation between base 46 of the side bearing housing 40 and an underside of the support plate 72 of the spring seat 70. Member 110, illustrated by way of example in FIG. 4, preferably embodies the teachings set forth in coassigned U.S. Pat. No. 7,338,034; the applicable portions of which are incorporated herein by reference. In the illustrated embodiment, member 110 defines a generally centralized bore 112 opening to axially aligned ends of member 110. It should be appreciated, however, member 110 could also be solidly configured. Suffice it to say, the thermoplastic member 110 preferably has an elastic strain to plastic strain ratio of about 1.5 to 1. Coassigned U.S. Pat. No. 4,198,037 to D. G. Anderson, the applicable portions of which are incorporated hereby by reference, better describes the composition and methodology for forming member 110.

The thermal insulator 120 of spring 100 is preferably arranged at one end of and is intended to operably protect the thermoplastic member 110 from the adverse affects of heat generated by the sliding frictional movements between the underside 15 of the railcar body 12 (FIG. 3) and the planar surface 83 on the side bearing cap 60 during movements of the railcar between locations. Suffice it to say, and in the illustrated embodiment, the thermal insulator 120 is operably carried at one end of the thermoplastic member 110 and is preferably of the type disclosed in coassigned U.S. Pat. Nos. 6,092,470; 6,892,999; and 7,044,061; the applicable portions of which are incorporated herein by reference.

In the embodiment illustrated for exemplary purposes in FIG. 4, the base 46 of the side bearing assembly 40 supports that end of the spring 100 opposite from the thermal insulator 120. Preferably, a spring guide or projection 42 is provided and is centrally located on the base 46 of the side bearing housing 40. In the illustrated embodiment, the spring guide 42 fits within the bore or recess 112 defined by member 110 whereby operably locating at least the lower end of the spring 100 within the side bearing assembly housing 40.

Returning to FIG. 2, the side bearing housing 40 along with at least one of the first and second members 70 and 80 of the multipiece cap 60 define cooperating instrumentalities 130 for guiding members the cap 60 for vertical reciprocatory movements relative to the housing 40 and for maintaining a predetermined relation between the cap 60 and the side bearing housing 40. As shown in FIG. 2, the interior surface 45 of the side bearing housing 40 preferably defines a pair of vertically extending splines or keys 132 which, in the illustrated embodiment, are positioned in diametrically opposed relation from each other. Each spline or key 132 extends along the interior surface 45 of the side bearing housing 40 for a vertical distance which is sufficient to accommodate and guide vertical reciprocatory movements of at least one member 70, 80 of the side bearing cap 60 during operation of the side bearing assembly 30.

Preferably, the vertically extending splines or keyway 132 are formed integral with the housing 40 and are disposed in general alignment with the longitudinal axis 54 defined by the side bearing housing 40. Moreover, and in a preferred form, each member 70, 80 of the multipiece cap 60 defines a recessed cutout or keyway 136 which is configured to receive a mating spline or key 132 on the side bearing housing 40 whereby guiding each member 70, 80 for vertical reciprocatory movements relative to the housing 40 while maintaining a predetermined relation between the members 70, 80 and the side bearing housing 40.

In the embodiment illustrated for exemplary purposes, the side bearing assembly 30 is configured to promote the dissipation of heat from the cavity 48 and away from the thermoplastic spring 100 thereby prolonging the usefulness of the side bearing assembly 30. As shown in FIGS. 2 and 3, wall structure 44 of the side bearing housing 40 preferably defines openings 140 and 142 disposed to opposite lateral sides of the longitudinal axis 47 of the side bearing housing 40. In one form, openings 140 and 142 are disposed toward a lower end of the side bearing housing 40 in a vicinity of an intersection between wall structure 44 and base 46. In the illustrated embodiment, the openings 140 and 142 are generally aligned along a line extending generally perpendicular or normal to the longitudinal axis 47 of housing 40. As will be appreciated, the openings 140 and 142 provides a particular advantage when a thermoplastic spring is used to resiliently urge the cap 60 against and into frictional sliding contact with an underside 15 of the railcar body 12 (FIG. 2).

The multipiece cap 60 of the side bearing assembly 30 is furthermore preferably designed to reduce the adverse affects of heat away on the thermoplastic spring 100 during operation of the side bearing assembly 30. More specifically, in the embodiment illustrated in FIG. 4, member 80 of the multipiece cap 60 includes a passage 150 for directing air preferably beneath the planar surface 83 of cap 60 whereby inhibiting conductive heat transfer from plate 82 to that end of the thermoplastic spring assembly 100 arranged proximate to member 80. Similarly, and in the embodiment illustrated in FIG, 4, member 70 of the multipiece cap 60 includes a passage 160 arranged in operable combination with passage 150 in member 80 for directing air between the upper frictional surface 83 of cap 60 and the adjacent end of the spring 100. The passage 150 and 160 in the cap structure 60 provides a particular advantage when a thermoplastic spring is used to resiliently urge the cap 60 against and into frictional sliding contact with an underside 15 of the railcar body 12 (FIG. 4).

The advantages provided by a side bearing assembly embodying principals of this invention disclosure are illustrated by way of example in FIG. 5. FIG. 5 schematically illustrates a calculated longitudinal force-displacement hysteresis loop of the present disclosure wherein the outer parallelogram defined by points ABCDEFA represents a cycle length of a side bearing assembly embodying principals of the present disclosure as the bolster 16 of truck assembly 10 oscillates or "hunts" between extreme positions of travel about the center bearing plate 22 (FIG. 1). It should be noted, however, the schematic illustration in FIG. 5 is intended for illustrative purposes only and should not be interpreted or construed, directly or indirectly, as representing actual measurements of loads applied to or movements associated with components parts of the side bearing assembly 30.

The area of the graph shown in FIG. 5 and defined by points ABZJKDEVLMA illustrates a calculated force-displacement hysteresis loop of a conventional side bearing assembly wherein a gap or space is required between the top cap and side bearing housing to allow for vertical displacement of the cap relative to the side bearing housing. More specifically, in the graph shown in FIG. 5, points ABZJKDEVLMA represent a cycle length of a conventional side bearing assembly 30 having a gap or space between the side bearing housing and cap and the effects on longitudinal loading of the side bearing assembly caused by such space or gap between the side bearing housing and cap as the truck assembly bolster 16 oscillates or "hunts" between extreme positions of travel about the center bearing plate 22 (FIG. 1).

Point A on the graph illustrated in FIG. 5 schematically represents the increased longitudinal loading on the side bearing assembly when the truck assembly bolster 16 (FIG. 1) is urged toward an extreme rotational position and the sidewalls of a conventional side bearing assembly are pressed into contact relative to each other by the longitudinal loads placed on the side bearing assembly as a result of the truck assembly "hunting" or yawing between positions as the railcar moves between locations. The distance between points A and B in FIG. 5 schematically represents the reduced longitudinal loading on the side bearing assembly as the truck assembly bolster 16 traverses in a first rotational direction away from one extreme rotational position.

Point B on the graph illustrated in FIG, 5 schematically represents the longitudinal loading on the side bearing when the railcar bolster is arranged toward a position, proximate to its extreme rotational position, but wherein the sidewalls of the side bearing housing and cap of the side bearing assembly have deflected as a result of the reduced longitudinal loads being removed therefrom. Points B and Z on the graph in FIG. 5 schematically illustrate the relatively constant longitudinal loading on the side bearing assembly as the truck assembly bolster 16 moves away from a position, proximate to its extreme rotational position, wherein longitudinal loads are lessened on and deflection has occurred to the sidewalls of the side bearing housing and cap, to a neutral or centered position. The relatively constant longitudinal loading of the railcar side bearing assembly remains as the cap longitudinally shifts in the gap between it and the side bearing housing is represented by the distance between points B and Z.

As shown in FIG. 5, between points Z and J, the longitudinal loading on the side bearing assembly loading remains relatively constant as the gap between the cap and side bearing assembly continues to collapse as the truck assembly bolster 16 continues to rotate about the center bearing plate 22 (FIG. 1) from the neutral position toward an opposite extreme rotational position. Point J on the graph shown in FIG. 5 represents the longitudinal loading on the side bearing assembly when the sidewalls of the side bearing housing and cap of a conventional side bearing assembly again contact relative to each other. The distance between points J and K on the graph shown in FIG. 5 schematically represents the increase in longitudinal loading on the side bearing assembly as the sidewalls of the side bearing housing and cap of a conventional side bearing assembly deflect as the bolster 16 continues to rotate or move toward the extreme rotational position during hunting movements of the truck assembly 10.

With the sidewalls of the side bearing housing and cap of a conventional side bearing assembly in contact relative to each other (point K), the longitudinal loading on the side bearing assembly remains relatively constant as indicated on the graph illustrated in FIG. 5 between points K and D. Between points K and D on the graph illustrated in FIG. 5, the railcar underside 15 slides relative to the side bearing assembly as the bolster continues to traverse toward an extreme rotational position.

Point D on the graph illustrated in FIG. 5 schematically represents the increased longitudinal loading on the side bearing assembly when the truck assembly bolster 16 (FIG. 1) is urged toward an extreme rotational position (opposite from the position represented in the graph shown in FIG. 5 by point A) and the sidewalls of the side bearing assembly are pressed into contact relative to each other by the increased longitudinal loads placed on the side bearing assembly as a result of the truck assembly "hunting" or yawing between positions as the railcar moves between locations. Between points D and E on the graph illustrated in FIG. 5, the longitudinal loading on the side bearing assembly is again reduced as a result of the truck assembly bolster 16 traversing in a second rotational direction away from one extreme rotational position toward a position arranged proximate the extreme rotational position but wherein deflection of the sidewalls of the side bearing housing and cap have occurred as a result of the longitudinal loads being removed therefrom. Points E and V on the graph in FIG. 5 schematically illustrate the relatively constant longitudinal loading on the side bearing assembly as the truck assembly bolster 16 moves away from a position, proximate to its extreme rotational position, wherein longitudinal loads are removed from the sidewalls of the side bearing housing and cap to a neutral or centered position. The relatively constant longitudinal loading of the railcar side bearing assembly remains as the cap longitudinally shifts in the gap between it and the side bearing housing is represented by the distance between points E and V.

As shown in FIG. 5, and between points V and L, the longitudinal loading on the side bearing assembly remains relatively constant as the gap between the cap and side bearing housing continues to collapse as the truck assembly bolster 16 continues to rotate about the center bearing plate 22 (FIG. 1) from the neutral position toward an opposite extreme rotational position and through a position (point L) wherein the sidewalls of the side bearing housing and cap of a conventional again come in contact relative to each other. The distance between points L and M on the graph shown in FIG. 5 schematically represents the increase in longitudinal loading on side bearing assembly as the sidewalls of the side bearing housing and cap, of a conventional side bearing assembly deflect as the bolster 16 continues to rotate or move toward the extreme rotational position during hunting movements of the truck assembly 10.

With the sidewalls of-the side bearing housing and cap of a conventional side bearing assembly being in contact relative to each other (point M), the longitudinal loading on the side bearing assembly remains relatively constant as indicated on the graph illustrated in FIG. 5 between points M and A. Between points M and A on the graph illustrated in FIG. 5, the railcar underside 15 slides relative to the side bearing assembly as the bolster continues to traverse toward an extreme rotational position.

The adverse affects of the spacing between the top cap and housing of a conventional side bearing assembly are illustrated in FIG. 5 by the distance between points B and J along with the distance between points E and L. That is, as the truck assembly bolster 16 rotates during "hunting" movements thereof, the rotational movement of the truck assembly bolster 16 places a force or longitudinal load on the side bearing assembly whereby causing the top cap of the side bearing assembly to longitudinally shift relative to the side bearing housing until the distance separating the wall structure of the top cap and the wall structure of the side bearing housing collapses. The collapse of the distance separating the wall of the top cap from the wall of the side bearing housing is schematically represented in FIG. 5 by the distance between points B and J along with E and L. It is important to note, the distance separating the wall of the top cap from the wall of the side bearing housing on a conventional side bearing assembly progressively worsens with wear. That is, the distance separating the wall of the top cap from the wall of the side bearing housing, schematically represented in FIG. 5 by the distance between points B and J along with E and L, continues to increase with wear. Increased wear between the cap and side bearing housing reduces the energy absorption capability of the side bearing assembly.

Notably, the side bearing assembly of the present disclosure is self-adjusting. That is, during operation of the side bearing assembly embodying features of the present disclosure, surfaces 75 and 85 of the top cap 60 automatically adjust to wear therebetween and, thus, are maintained in constant contact with the interior surface of the side bearing housing 40. Accordingly, and with the present disclosure, there is substantially no lost motion between the top cap 60 and side bearing housing 40 when the truck assembly 10 shifts from one rotational position to the other. Accordingly, and as schematically represented in FIG. 5, those shaded areas marked with diagonal lines in the graph shown FIG. 5 are advantageously available for energy absorption by the side bearing assembly 30 during operation of the railcar 13 (FIG. 2). Moreover, and as noted above, those shaded areas marked with diagonal lines in the graph shown FIG. 5 schematically illustrating the enhanced ability of the side bearing assembly of the present disclosure to absorb energy will only increase when considering wear between the cap and side bearing housing of a conventional side bearing assembly.

Figure 6:
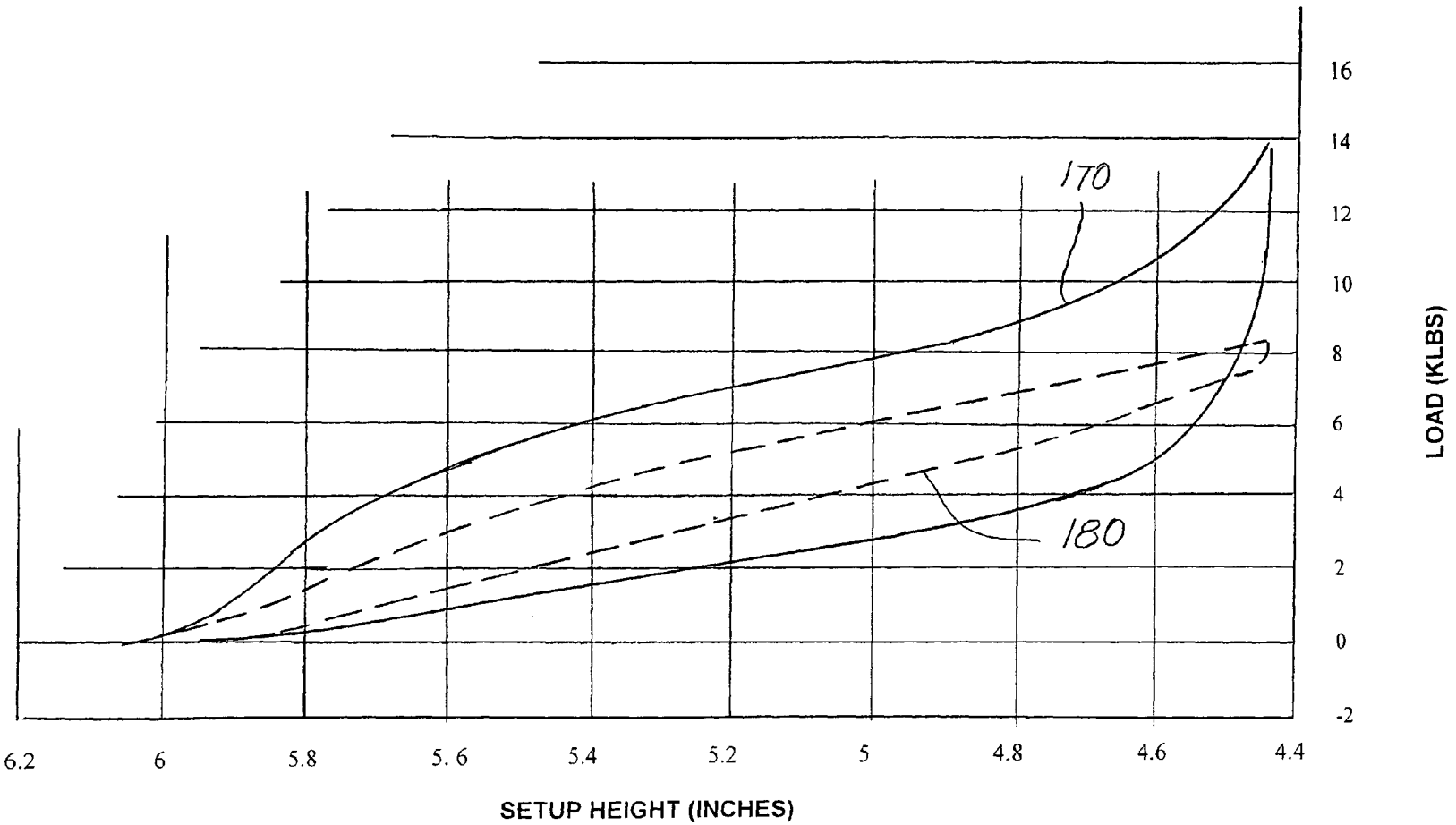
FIG. 6 is a graph showing the enhanced vertical energy capability offered by a side bearing assembly according to the invention disclosure and a prior art type constant contact side bearing assembly.

The advantages of a side bearing assembly embodying principals and teachings of the present disclosure are further exemplified in FIG. 6. The solid line or hysteresis loop 170 in the graph illustrated in FIG. 6 represents the vertical energy absorption capabilities of the side bearing assembly 30. The dash line or hysteresis loop 180 in the graph illustrated in FIG. 6 represents the vertical energy absorption capabilities of a conventional side bearing assembly. The enhanced ability of the side bearing assembly 30 to absorb, dissipate and return energy to the railcar as compared to a conventional side bearing design is readily apparent when the two hysteresis loops 170 and 180 are compared.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A constant contact side bearing assembly for a railcar, comprising:

a housing including upstanding wall structure defining a central axis for said side bearing assembly;

a multipiece cap arranged in operable combination with said housing and including a first member arranged within said housing and having wall structure arranged to frictionally contact the wall structure of said housing during vertical movements of said first member, with the wall structure of said first member being arranged to one side of the central axis of said side bearing assembly, a second member arranged within said housing and carried by said first member, said second member including wall structure arranged to frictionally contact said wall structure of said housing during vertical movements of said second member, with the wall structure of said second member being arranged to a second side of the central axis of said side bearing assembly, and wherein a portion of said second member extends beyond the wall structure of said housing and defines a friction surface for said cap, with said friction surface being urged into constant engagement with a related part on said railcar;

a spring arranged within said housing and generally centralized below both of said first and second members of said multipiece cap for urging the friction surface on said cap into frictional contact with said related part on said railcar; and wherein said first and second members of said multipiece cap define non-vertical interengaging and slidable surfaces therebetween and disposed at an angle ranging between about 20 degrees and about 30 degrees relative to a horizontal plane for maintaining the wall structure on each of said members in frictional contact with the wall structure of said housing thereby limiting horizontal shifting movements of said friction surface relative to said housing while maintaining vertical reciprocity of said cap relative to said housing during operation of said side bearing assembly.

2. The constant contact side bearing assembly according to claim 1 wherein, said housing and at least one member of said multipiece cap define cooperating instrumentalities for guiding said members for vertical reciprocatory movements relative to said housing and for maintaining a predetermined relation between said members and said housing.

3. The constant contact side bearing assembly according to claim 1 wherein, said spring includes an elastomeric member having first and second axially aligned ends.

4. The constant contact side bearing assembly according to claim 3 wherein, said housing defines a pair of openings for venting heat from said housing.

5. The constant contact side bearing assembly according to claim 3 wherein, at least one member of said multipiece cap defines an opening for allowing air to pass beneath the friction surface of said cap.

6. The constant contact side bearing assembly according to claim 3 wherein, said housing includes a base with generally horizontal flange portions extending in opposite directions and away from the central axis of said side bearing assembly, with each flange portion defining an aperture therein.

7. The constant contact side bearing assembly according to claim 6 wherein, the apertures defined by said flange portions are aligned relative to each other along an axis extending generally parallel to a longitudinal axis of said railcar.

8. The constant contact side bearing assembly according to claim 1 wherein, the base of said housing supports one end of said spring.

9. A constant contact side bearing assembly for a railcar, comprising:

a housing including wall structure defining a central axis for said side bearing assembly;

a multipiece cap arranged in operable combination with said housing, said cap including movable first member within said housing, a movable second member arranged at least partially within said housing and carried by first member, with a portion of said second member extending beyond said housing and defining a friction surface for said cap, with the friction surface of said cap being arranged to frictionally contact a railcar body structure;

a spring arranged within said housing and generally centralized below both of said first and second members of said multipiece cap for resiliently urging said the friction surface of said cap into frictional contact with said railcar body structure; and wherein said cap members define cooperating angled surfaces therebetween and disposed at an angle ranging between about 20 degrees and about 30 degrees relative to a horizontal plane for urging wall structure on said first member and wall structure on said second member into frictional engagement with the wall structure on said housing in response to a vertical load acting on the friction surface of the cap while maintaining vertical reciprocity of said cap relative to said housing during operation of said side bearing assembly.

10. The constant contact side bearing assembly according to claim 9 wherein, said spring includes an elastomeric member having first and second axially aligned ends.

11. The constant contact side bearing assembly according to claim 10 wherein, said housing defines a pair of openings for venting heat from said housing.

12. The constant contact side bearing assembly according to claim 10 wherein, at least one of said cap members is configured with a passage for directing air beneath the friction surface of said cap.

13. The constant contact side bearing assembly according to claim 10 wherein, said housing includes a base with generally horizontal flange portions extending in opposite directions and away from the central axis of said side bearing assembly, with each flange portion defining an aperture therein.

14. The constant contact side bearing assembly according to claim 13 wherein, the apertures defined by said flange portions are aligned relative to each other along a longitudinal axis extending generally parallel to an elongated longitudinal axis of said railcar.

15. The constant contact side bearing assembly according to claim 14 wherein, said housing and at least one member of said multipiece cap define cooperating instrumentalities for guiding said cap members for vertical reciprocatory movements relative to said housing and for maintaining a predetermined relation between said cap members and said housing.

16. The constant contact side bearing assembly according to claim 15 wherein, said cooperating instrumentalities are arranged in line with the longitudinal axis defined by the aligned apertures in the flange portions of said housing.

17. The constant contact side bearing assembly according to claim 10 wherein, the base of said housing supports one end of said spring.

18. A constant contact side bearing assembly for a railcar, comprising:

a housing including vertical wall structure defining a central axis for said side bearing assembly;

a spring seat arranged within said housing for vertical movement;

a top cap at least partially arranged within said housing for vertical movement, with said top cap having a plate portion spaced at least partially above the wall structure of said housing so as to define a friction surface for said side bearing assembly, with said top cap being carried by said spring seat;

a spring arranged within said housing and generally centralized below said spring seat and said top cap for resiliently urging said friction surface of said top cap into frictional contact with a part on said railcar; and wherein said spring seat and said top cap define cooperating angled surfaces therebetween and disposed at an angle ranging between about 20 degrees and about 30 degrees relative to a horizontal plane for urging said spring seat and said top cap in opposed generally horizontal directions away from the central axis of said side bearing assembly such that wall structure on each of said spring seat and said top cap is moved onto friction engagement with the wall structure on said housing in response to a vertical load acting on said plate portion of said outer cap while maintaining vertical reciprocity of said spring seat and said top cap relative to said housing.

19. The constant contact side bearing assembly according to claim 18 wherein, said spring includes an elastomeric member having first and second axially aligned ends.

20. The constant contact side bearing assembly according to claim 19 wherein, said housing defines a pair of openings for venting heat from said housing.

21. The constant contact side bearing assembly according to claim 19 wherein, said top cap defines a passage for directing air to pass through beneath the friction surface of said top cap.

22. The constant contact side bearing assembly according to claim 18 wherein, said housing includes a base with generally horizontal flange portions extending in opposite directions and away from the central axis of said side bearing assembly, with each flange portion defining an aperture therein.

23. The constant contact side bearing assembly according to claim 22 wherein, the base of said housing supports one end of said spring.

24. The constant contact side bearing assembly according to claim 22 wherein, the apertures defined by said flange portions are aligned relative to each other along a longitudinal axis extending generally parallel to an elongated longitudinal axis of said railcar.

25. The constant contact side bearing assembly according to claim 24 wherein, said housing and at least one said spring seat and top cap define cooperating instrumentalities for guiding said spring seat and said top cap for vertical reciprocatory movements relative to said housing and for maintaining a predetermined relation between said spring seat, said top cap and said housing.

26. The constant contact side bearing assembly according to claim 25 wherein, said cooperating instrumentalities are arranged in line with the longitudinal axis defined by the aligned apertures in the flange portions of said housing.

* * * * *